US008833212B2

(12) United States Patent
Hsieh

(10) Patent No.: US 8,833,212 B2
(45) Date of Patent: Sep. 16, 2014

(54) ELECTRICAL TORQUE SCREWDRIVER

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 408 days.

(21) Appl. No.: 13/450,492

(22) Filed: Apr. 19, 2012

(65) Prior Publication Data

US 2012/0304838 A1 Dec. 6, 2012

(30) Foreign Application Priority Data

Jun. 3, 2011 (TW) ..... 100119593 A

(51) Int. Cl.
*B25B 23/159* (2006.01)
*B25B 23/142* (2006.01)
*B25B 21/00* (2006.01)

(52) U.S. Cl.
CPC ..... *B25B 21/00* (2013.01); *B25B 23/1427* (2013.01)
USPC ..... 81/482; 81/479

(58) Field of Classification Search
USPC ..... 81/467, 472, 475, 476, 477, 478, 479, 81/480, 482; 73/862.21–862.26
See application file for complete search history.

(56) References Cited

U.S. PATENT DOCUMENTS

| | | | | | |
|---|---|---|---|---|---|
| 2,556,587 | A * | 6/1951 | Keen | 81/482 |
| 2,614,418 | A * | 10/1952 | Shaff | 73/862.21 |
| 3,847,038 | A * | 11/1974 | Green | 81/477 |
| 4,208,555 | A * | 6/1980 | Ikeda et al. | 200/52 R |
| 5,890,406 | A * | 4/1999 | Thorn | 81/468 |
| 6,276,243 | B1 * | 8/2001 | Jenkins | 81/479 |
| 6,339,977 | B1 * | 1/2002 | Lee et al. | 81/58.3 |
| 6,526,853 | B2 * | 3/2003 | Jenkins | 81/479 |
| 2009/0013836 | A1 * | 1/2009 | Chen | 81/468 |

* cited by examiner

*Primary Examiner* — Robert Scruggs
(74) *Attorney, Agent, or Firm* — CKC & Partners Co., Ltd.

(57) ABSTRACT

An electrical torque screwdriver includes a handle, a shaft, a torque limiter, and an electrical switch. The shaft is disposed on the handle and rotatable but not movable linearly. The torque limiter includes a driving tooth, a slipping block, a pawl, and at least one restoring element. The driving tooth is disposed on the shaft. The slipping block is disposed on the handle. The slipping block is displaceable linearly but not rotatable. The pawl is disposed on the slipping block and engaged with the driving tooth. The restoring element is pivotally disposed on the handle and has a restoring force, wherein one end of the restoring element resists against the slipping block for pushing the pawl to be engaged with the driving tooth. The electrical switch is disposed on the handle for optionally resisting against the other end of the restoring element to stop the restoring element.

5 Claims, 5 Drawing Sheets

ELECTRICAL TORQUE SCREWDRIVER

RELATED APPLICATIONS

The application claims priority to Taiwan Application Serial Number 100119593, filed Jun. 3, 2011, which is herein incorporated by reference.

BACKGROUND

1. Field of Invention

The present invention relates to a screwdriver. More particularly, the present invention relates to an electrical torque screwdriver.

2. Description of Related Art

In general, if a user applies a force on a screwdriver, the applied force will be completely transmitted to a workpiece. Therefore, when the applied force is greater than what the workpiece can take, the workpiece will be damaged. Thus, some people apply the technique of torque wrench on the screwdriver for allowing the screwdriver to loose the workpiece, thereby avoiding damaging the workpiece when the workpiece receives too much force from the user. However, such a screwdriver will not be able to perform jobs requiring larger torque.

SUMMARY

Therefore, an aspect of the present invention is to provide an electrical torque screwdriver. When the applied force is greater than what the workpiece can take, the electrical torque screwdriver will slip from the workpiece to avoid damaging the workpiece. In addition, the electrical torque screwdriver can be switched to a screwdriver for general use.

According to an embodiment of the present invention, the electrical torque screwdriver includes a handle, a shaft, a torque limiter and electrical switch. The shaft is disposed on the handle, wherein the shaft is rotatable but not movable linearly. The torque limiter includes a driving tooth, a slipping block, a pawl and at least one restoring element. The driving tooth is disposed on the shaft. The slipping block is disposed on the handle, wherein the slipping block is displaceable linearly but not rotatable. The pawl is disposed on the slipping block and engaged with the driving tooth. The restoring element which is pivotally disposed on the handle and has a restoring force, wherein one end of the restoring element resists against the slipping block for pushing the pawl to be engaged with the driving tooth. The electrical switch is disposed on the handle for optionally resisting against the other end of the restoring element to stop the restoring element.

When an excessive force is applied through the handle to the torque limiter, the torque limiter will be loosened to prevent the shaft from damaging the workpiece. If the electrical switch resists against the restoring element, the torque limiter will not be loosened; and can be used as a general-use screwdriver for performing jobs requiring greater torque.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
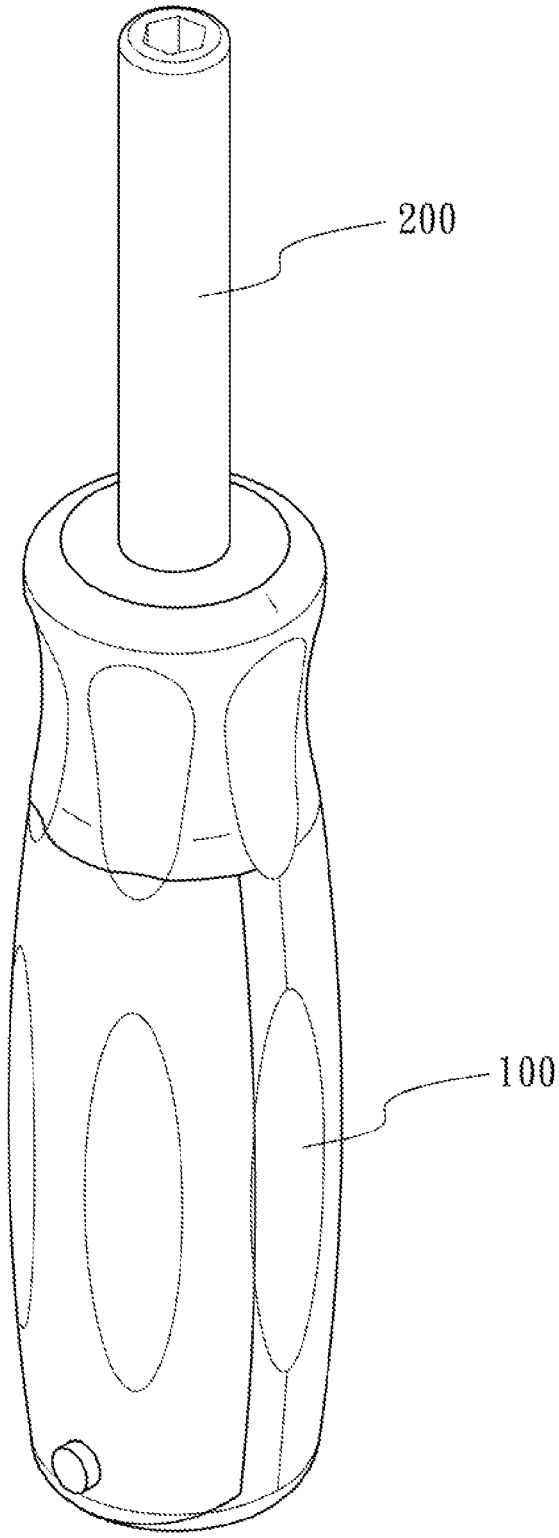
FIG. 1 is a schematic three-dimensional view of an electrical torque screwdriver according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
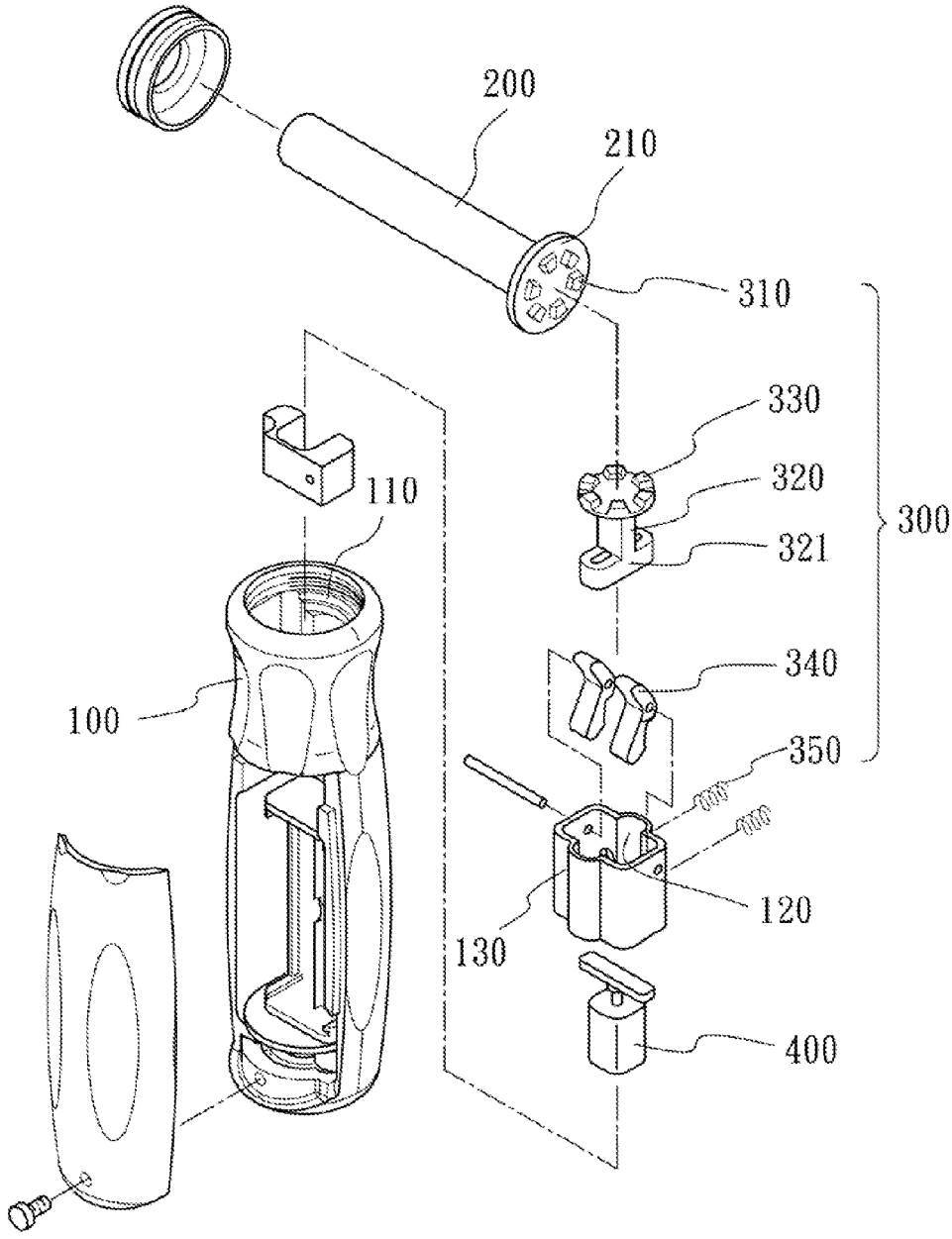
FIG. 2 is a schematic exploded view of the electrical torque screwdriver shown in FIG. 1.

FIG. 1 is a schematic three-dimensional view of an electrical torque screwdriver according to one embodiment of the present invention. FIG. 2 is a schematic exploded view of the electrical torque screwdriver shown in FIG. 1. As shown in FIG. 1 and FIG. 2, the electrical torque screwdriver includes a handle 100, a shaft 200, a torque limiter 300 and electrical switch 400. The shaft 200 is disposed on the handle 100, wherein the shaft 200 is rotatable but not movable linearly. The torque limiter 300 includes a driving tooth 310, a slipping block 320, a pawl 330 and at least one restoring element 340. The driving tooth 310 is disposed on the shaft 200. The slipping block 320 is disposed on the handle 100, wherein the slipping block 320 is displaceable linearly but not rotatable. The pawl 330 is disposed on the slipping block 320 and engaged with the driving tooth 310. The restoring element 340 is pivotally disposed on the handle 100 and has a restoring force, wherein one end of the restoring element 340 resists against the slipping block 320 for pushing the pawl 330 to be engaged with the driving tooth 310. The electrical switch 400 is disposed on the handle 100 for optionally resisting against the other end of the restoring element 340 to stop the restoring element 340.

Figure 3:
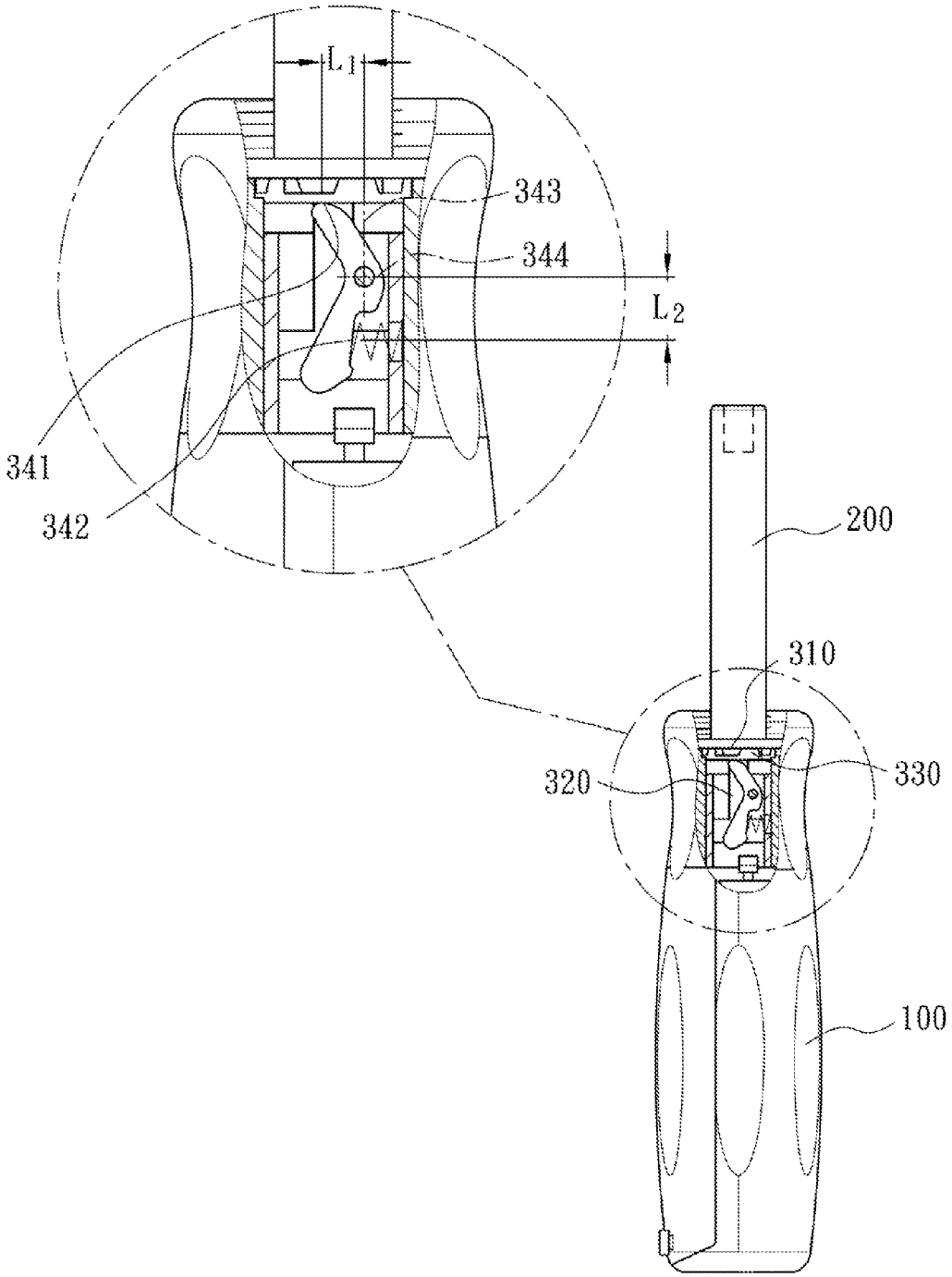
FIG. 3 is a schematic partial cross-sectional view of a driving tooth engaged with a pawl shown in FIG. 1.

FIG. 3 is a schematic partial cross-sectional view of the driving tooth 310 engaged with a pawl 330 shown in FIG. 1. When a user rotates the handle 100, the shaft 200 will be driven through the slipping block 320, the pawl 330 and the driving tooth 310. Therefore, if a screwdriver head or a socket is mounted on the shaft 200, the screwdriver can be used for loosening or tightening screws or nuts.

Figure 4:
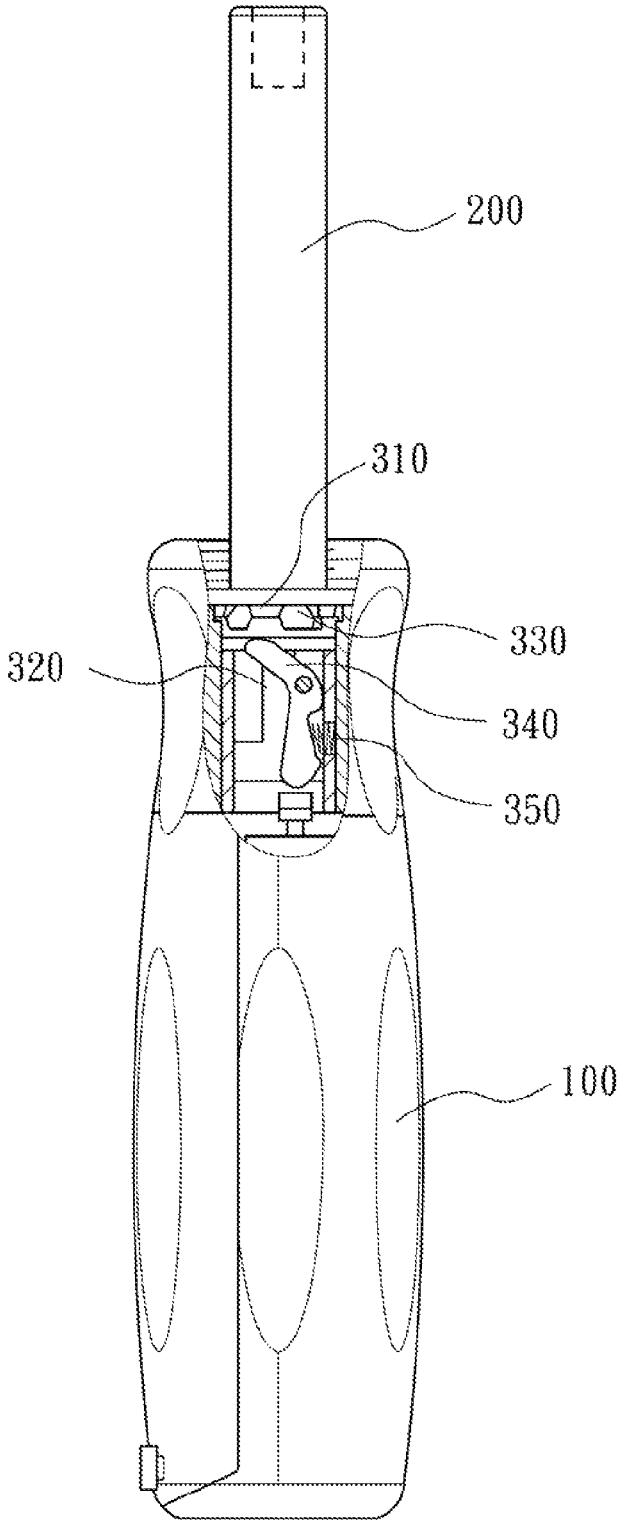
FIG. 4 is a schematic partial cross-sectional view of the driving tooth escaping from the pawl shown in FIG. 3.

FIG. 4 is a schematic partial cross-sectional view of the driving tooth 310 escaping from the pawl 330 shown in FIG. 3. When the applied force is large enough to compress a spring 350 for pushing the restoring element 340 to rotate, the pawl 330 and the slipping block 320 will be displaced linearly, so that the pawl 330 will escape from driving tooth 310. At this time, the slipping block 320 will push the restoring element 340 to rotate. Accordingly, the shaft 200 and the handle 100 will rotate oppositely, and thus the applied force cannot be transmitted to the shaft 200.

Figure 5:
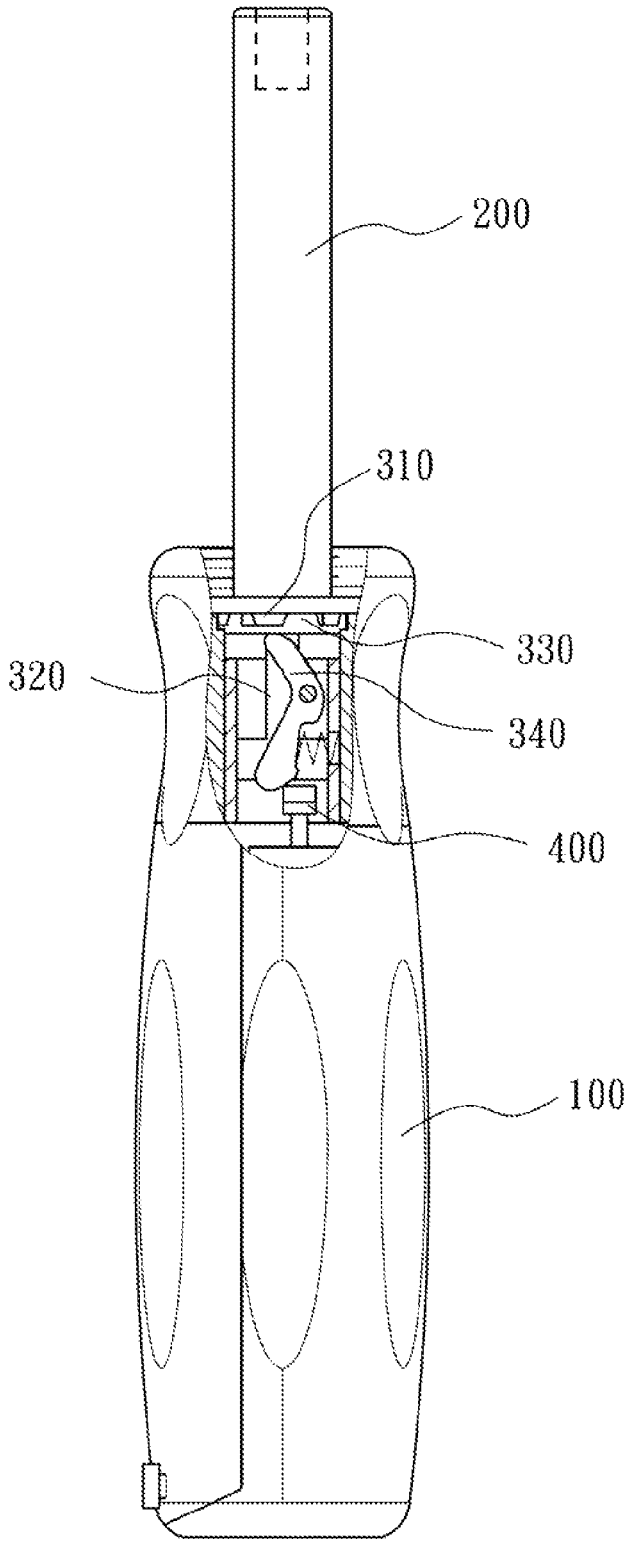
FIG. 5 is a schematic partial cross-sectional view of an electrical switch resisting against a restoring element shown in FIG. 3.

FIG. 5 is a schematic partial cross-sectional view of the electrical switch 400 resisting against a restoring element 340 shown in FIG. 3. When the user switches the electrical switch 400 to make the electrical switch 400 resist against the restoring element 340, the slipping block 320 will not be displaced linearly, so that the pawl 330 cannot escape from driving tooth 310. Hence, when the user applies a force on the handle 100, the applied force can be completely transmitted to the shaft 200 as general use of a screwdriver.

Referring to FIG. 2, a technique that the shaft 200 disposed on the handle 100 is rotatable but not movable linearly, is that a ring groove 110 is disposed on the handle 100, and a circular disk 210 is disposed on the shaft 200, wherein the circular disk 210 is accommodated in the ring groove 110. Therefore, the circular disk 210 can rotate around in the ring groove 110 but not move linearly to achieve the technique that the shaft 200 is rotatable but not movable linearly.

A technique that the slipping block 320 disposed on the handle 100 is displaceable linearly but not rotatable, is that a rectangle sliding block 321 is disposed on the slipping block 320, and a sliding track 120 is disposed on the handle 100, wherein the sliding block 321 is accommodated in the sliding track 120. Therefore, the sliding block 321 can displace linearly but not rotate around to achieve the technique that the slipping block 320 is displaceable linearly but not rotatable.

A technique that the restoring element 340 has a restoring force means that an elastic element is disposed in the handle 100. In other words, two ends of the elastic element are respectively connected to the restoring element 340 and the handle 100. When the restoring element 340 is forced to rotate, the elastic element will be compressed to save the force. When the applied force of the restoring element 340 is released, the restoring element 340 will be rotated in place by the restoring force of the elastic element. However, the technique of the restoring force, such as how to set up and connect to the elastic element etc, is a well known technology and thus is not described again. On the embodiment, the spring 350 is an example of the elastic element 350, and the spring 350 is also an example for its two ends respectively to resist against the handle 100 and the restoring element 340.

The electrical switch 400 means that the device is controlled by current. In other words, the electrical switch 400 will be driven to resist against the restoring element 340 when the current is inputted to the electrical switch 400. However, there is also a possibility that, the electrical switch 400 will be driven to leave from the restoring element 340 when the current is inputted to the electrical switch 400. As described above, the driven technique is designed in accordance with user or designer requirements. The embodiment is an example that the electrical switch 400 is driven to resist against the restoring element 340 when the current is inputted to the electrical switch 400. The most common electrical switch 400 is a solenoid valve. In the embodiment, a solenoid valve is an example of the electrical switch 400. However, the electrical switch 400 is a well known device and thus is not described herein again.

In the embodiment, the electrical switch 400 is a solenoid valve. When the electrical switch 400 is stretched to resist against the restoring element 340, the pawl 330 cannot escape from driving tooth 310 and can be operated as a general-use screwdriver. When the electrical switch 400 is withdrawn back, the slipping block 320 can be displaced linearly, and thus the pawl 330 can escape from driving tooth 310 and can be operated as a general-use torque screwdriver. Since solenoid valve is a popular product presented in the market, the material cost can be reduced greatly.

The handle 100 includes a frame 130, and the restoring element 340 is pivotally disposed on the frame 130, and the sliding track 120 is also disposed on the frame 130. The design and production difficulties can be simplified if the restoring element 340 and the slipping block 320 are combined on the frame 130.

The number of the restoring elements 340 is two, and the two restoring elements 340 are coaxial and pivotally disposed on the handle 100. Using the two restoring elements 340 to resist against the slipping block 320 can improve the stability of linear displacement of the slipping block 320.

Referring to FIG. 3, the restoring element 340 includes a stopping part 341, a restoring driving part 342, a first axis 343 and a second axis 344. The stopping part 341 resists against the slipping block 320. The first axis 343 passing through a central pivot point of the restoring element 340 and the handle 100 is parallel to a displacement direction of the slipping block 320. The second axis 344 passing through the central pivot point of the restoring element 340 and the handle 100 is parallel to a restoring direction. A first distance L1 vertical to the first axis 343 is the shortest distance formed between the stopping part 341 and the first axis 343, and a second distance L2 vertical to the second axis 344 is the shortest distance formed between the restoring driving part 342 and the second axis 344. Under a condition of the driving tooth 310 engaged with the pawl 330, the first distance L1 is smaller than the second distance L2.

Therefore, if the torque (the applied force by the slipping block 320×the first distance L1) made by the slipping block 320 for rotating the restoring element 340 is the same as the torque (the restoring force by the spring 350×the first distance L2) made by the spring 350 for rotating the restoring element 340, the applied force by the slipping block 320 has to be greater than the restoring force by the spring 350. In other words, when the user applies a force to compress the spring 350 for pushing the restoring element 340 to rotate, since the first distance L1 is smaller than the second distance L2, the spring 350 with a smaller spring constant ($k=F/x$, k is a spring constant; F is an applied force; x is a stretched or compressed distance) can be used for providing the user with a greater resistance. Since the price of the spring 350 with a smaller spring constant is relatively low, the overall manufacturing cost can be reduced.

The restoring driving part 342 indicates a position connected to the elastic element. In the embodiment, the restoring driving part 342 is the place resisted against by the spring 350.

The restoring direction is a direction of a restoring force applied on the restoring element 340 by the elastic element. In the embodiment, the restoring direction is the direction of the spring 350 resisting against the restoring element 340.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electrical torque screwdriver, comprising:

a handle;

a shaft disposed on the handle, wherein the shaft is rotatable but not movable linearly;

a torque limiter, comprising:

a driving tooth disposed on the shaft;

a slipping block disposed on the handle, wherein the slipping block is displaceable linearly but not rotatable;

a pawl disposed on the slipping block and engaged with the driving tooth; and at least one restoring element which is pivotally disposed on the handle and has a restoring force, wherein one end of the restoring element resists against the slipping block for pushing the pawl to be engaged with the driving tooth; and an electrical switch disposed on the handle for optionally resisting against the other end of the restoring element to stop the restoring element.

2. The electrical torque screwdriver of claim 1, wherein the electrical switch is a solenoid valve.

3. The electrical torque screwdriver of claim 1, wherein the handle comprises a frame, and the restoring element is pivotally disposed on the frame.

4. The electrical torque screwdriver of claim 1, wherein the number of the restoring elements is two, and the two restoring elements are coaxial and pivotally disposed on the handle.

5. The electrical torque screwdriver of claim 1, wherein the restoring element comprises a stopping part, a restoring driving part, a first axis and a second axis, wherein the stopping part resists against the slipping block, and the first axis which passes through a central pivot point of the restoring element and the handle is parallel to a displacement direction of the slipping block, and the second axis which passes through the central pivot point of the restoring element, and the handle is parallel to a restoring direction, and a first distance vertical to the first axis is formed between the stopping part and the first axis, and a second distance vertical to the second axis is formed between the restoring driving part and the second axis, and under a condition of the driving tooth engaged with the pawl, the first distance is smaller than the second distance.

* * * * *